US008363869B2

(12) United States Patent
Brimhall et al.

(10) Patent No.: US 8,363,869 B2
(45) Date of Patent: Jan. 29, 2013

(54) HEARING AID HOUSING APPARATUS

(75) Inventors: Owen Brimhall, South Jordan, UT (US); Jeremy Horton, Sandy, UT (US); Craig Collotzi, Riverton, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 1297 days.

(21) Appl. No.: 12/119,337

(22) Filed: May 12, 2008

(65) Prior Publication Data

US 2009/0279727 A1 Nov. 12, 2009

(51) Int. Cl.
*H04R 25/00* (2006.01)

(52) U.S. Cl. ..... 381/322; 381/323; 381/325

(58) Field of Classification Search ..... 381/322–324, 381/328, 330, 325
See application file for complete search history.

(56) References Cited

U.S. PATENT DOCUMENTS

| | | | |
|---|---|---|---|
| 3,641,288 | A | 2/1972 | Lamp |
| 5,012,582 | A | 5/1991 | Bristol et al. |
| 5,687,242 | A | 11/1997 | Iburg |
| 5,784,470 | A | 7/1998 | Fackler et al. |
| 6,546,108 | B1 | 4/2003 | Shennib et al. |
| 6,589,688 | B2 | 7/2003 | Jorgensen et al. |
| 2001/0043709 | A1 | 11/2001 | Panitzsch |
| 2007/0242845 | A1 | 10/2007 | Westermann |

FOREIGN PATENT DOCUMENTS

| | | |
|---|---|---|
| EP | 0004988 | 10/1979 |

*Primary Examiner* — Elvin G Enad
*Assistant Examiner* — Andrew R Millikin
(74) *Attorney, Agent, or Firm* — Birch, Stewart, Kolasch & Birch, LLP

(57) ABSTRACT

A hearing aid including an audio-processing device. The audio-processing device may be configured to receive a signal from a microphone and send the signal to a receiver. The hearing aid may include a hearing aid housing coupled to the audio-processing device. The hearing aid housing may have a body and a battery door. The battery door may be coupled to the body to form a battery cavity. The battery door may be movable about an axis of rotation that extends through a circular cross section of the battery cavity. Additional hearing aid housing configurations and methods for manufacturing hearing aids are also disclosed.

5 Claims, 6 Drawing Sheets

HEARING AID HOUSING APPARATUS

BACKGROUND

Hearing aid manufacturers have been dealing with the challenge of powering hearing aids for decades. As battery technology has developed, hearing aid manufacturers have been able to create smaller hearing aids. However, the size of a battery in a hearing aid still typically corresponds to the overall size of the hearing aid. Smaller hearing aids typically have smaller batteries, and smaller batteries may have shorter lives. Thus, hearing aid users may have to replace or recharge batteries in small hearing aids more often than in larger hearing aids.

Traditional behind-the-ear hearing aids may provide access to batteries with either swing-out compartments or trap doors. In hearing aids with swing-out battery compartments, the entire battery compartment may rotate in and out of the hearing aid housing. The battery may be retained in the compartment and may move with the compartment. Also, the rotational axis of a swing-out battery compartment may be located away from the battery. Alternatively, some hearing aids may include a "trap door" type battery door that provides access to the battery. A trap door may be a simple, relatively flat hinged door that opens to allow access to a battery cavity inside the hearing aid housing.

Traditional hearing aid housing and battery door configurations may not allow for larger batteries to be used with smaller hearing aids. Thus, traditional small form factor hearing aids may not have optimal battery life. Furthermore, replacing or recharging batteries in hearing aids with traditional housing and battery door configurations may be frustrating for some hearing aid wearers.

SUMMARY

According to certain embodiments, a hearing aid may comprise an audio-processing device configured to receive a signal from a microphone and send the signal to a receiver. The hearing aid may also comprise a hearing aid housing coupled to the audio-processing device. The hearing aid housing may comprise a body and a battery door coupled to the body to form a battery cavity. The battery door may be movable about an axis of rotation that extends through a circular cross section of the battery cavity to move the battery door between open and closed positions.

In at least one embodiment, the axis of rotation of the battery door is at least substantially parallel with the cylindrical axis of the battery cavity. In other embodiments, a battery may be positioned in the battery cavity, and the axis of rotation of the battery door may be at least substantially coaxial with the cylindrical axis of the battery. In some embodiments, the battery door may be configured to retract to expose at least a portion of a negative terminal and at least a portion of a positive terminal of a battery positioned in the battery cavity. The battery door may be configured to retract to allow a battery charger to be coupled to the battery.

In some embodiments, the hearing aid may include a positive battery contact in the battery cavity. The positive battery contact may be positioned to couple a positive terminal of a battery to the audio processing device. The hearing aid may also include a negative battery contact in the battery cavity. The negative battery contact may be positioned to couple a negative terminal of the battery to the audio processing device. The battery door may be configured to rotate to a first position that disconnects the battery from the positive and negative battery contacts.

According to various embodiments, the battery door may comprise a protrusion. The protrusion may be configured to hold the battery in at least one of an open position, a partially-open position, or a closed position. In some embodiments, the hearing aid housing may be configured to hold the battery in the battery cavity in a stationary position while the battery door opens. According to at least one embodiment, the battery door may be at least substantially concentric with the battery cavity. The battery door may be configured to at least partially retract into the body of the hearing aid housing.

In some embodiments, the battery door may comprise a first end positioned within the body of the hearing aid housing. The battery door may also comprise a second end. The second end may comprise a tab extending away from the body of the hearing aid housing.

According to various embodiments, the hearing aid housing may enclose a first volume. The battery cavity may comprise a second volume. The first volume may comprise the second volume, and a ratio of the second volume to the first volume may be at least 0.10. In some embodiments, the battery door may be semicylindrically shaped. The battery door may also be configured to hold the battery at least partially outside the body of the hearing aid housing when the battery door is in a closed position.

According to certain embodiments, a hearing aid may comprise an audio-processing device configured to receive a signal from a microphone and send the signal to a receiver. The hearing aid may also comprise a hearing aid housing coupled to the audio-processing device. The hearing aid housing may comprise a body and a battery door. The battery door may be configured to open by at least partially retracting into the hearing aid housing. The battery door may have a semicylindrical shape.

In some embodiments, the battery door may be coupled to the body of the hearing aid housing to form a battery cavity. An axis of rotation of the battery door may be at least substantially parallel with a cylindrical axis of the battery cavity. The battery door may be configured to retract to expose at least a portion of a negative terminal and at least a portion of a positive terminal of a battery positioned in the battery cavity.

In some embodiments, the hearing aid may comprise a positive battery contact. The positive battery contact may be positioned to couple a positive terminal of a battery to the audio processing device. The hearing aid may also include a negative battery contact. The negative battery contact may be positioned to couple a negative terminal of the battery to the audio processing device. The battery door may be configured to rotate to an open position that disconnects the battery from the positive and negative battery contacts.

In some embodiments, the hearing aid housing may enclose a first volume. The battery cavity may enclose a second volume, and the first volume may comprise the second volume. A ratio of the second volume to the first volume may be at least 0.10.

According to certain embodiments, the hearing aid housing may comprise an audio-processing device configured to receive a signal from a microphone and send the signal to a receiver. The hearing aid may also comprise a hearing aid housing enclosing the audio-processing device. The hearing aid housing may comprise a body and a battery door. The battery door may be coupled to the hearing aid housing to form a battery cavity. The battery door battery door may be movable about an axis of rotation that extends through the battery cavity to move the battery door between open and closed positions. The hearing aid may be configured to hold the battery in the battery cavity while the battery door opens.

According to at least one embodiment, the axis of rotation of the battery door is at least substantially parallel with a cylindrical axis of the battery cavity. In some embodiments, the battery door may be configured to retract to expose at least a portion of a negative terminal and at least a portion of a positive terminal of a battery positioned in the battery cavity.

In at least one embodiment, the hearing aid may comprise a positive battery contact in the battery cavity. The positive battery contact may be positioned to couple a positive terminal of a battery to the audio processing device. The hearing aid may also comprise a negative battery contact in the battery cavity. The negative battery contact may be positioned to couple a negative terminal of the battery to the audio-processing device. The battery door may be configured to rotate to an open position that disconnects the battery from the positive and negative battery contacts. In some embodiments, the battery door may comprise a protrusion. The protrusion may be configured to hold the battery door open.

According to certain embodiments, a hearing aid may comprise a hearing aid housing enclosing a first volume. The hearing aid housing may comprise a body and a battery cavity. The battery cavity may comprise a second volume within the first volume. In other words, the volume of the hearing aid housing may include the volume of the battery cavity. A ratio of the second volume (i.e., the volume of the battery cavity) to the first volume (i.e., the volume of the hearing aid housing, which includes the battery cavity) may be at least 0.10. The hearing aid may also comprise an audio-processing device positioned within the hearing aid housing and configured to receive a signal from a microphone and send the signal to a receiver.

According to various embodiments, the ratio of the second volume to the first volume may be at least 0.20. In some embodiments, the ratio of the second volume to the first volume may be at least 0.30. The hearing aid may further comprise a battery door. The hearing aid housing may be configured to hold a battery at least partially outside the body of the hearing aid housing when the battery door is in a closed position. The battery door may be semicylindrically shaped.

According to at least one embodiment, the hearing aid housing may be configured to hold at least a fourth of the battery outside the body section when the battery door is in a closed position. In some embodiments, the hearing aid may comprise positive and negative battery contacts in the battery cavity. The hearing aid may also include a battery door. A portion of the battery door may be positioned between the positive and negative battery contacts.

In some embodiments, the housing may comprise a length of less then 0.9 inches. The battery cavity may comprise a diameter of less then 0.4 inches. The housing may comprise a width of less then 0.3 inches, and the battery cavity may comprise a width of at least 0.2 inches. The hearing aid may also comprise a battery door coupled to the hearing aid housing to form the battery cavity. The battery door may comprise an axis of rotation that extends through a circular cross section of the battery cavity.

In certain embodiments, a method for manufacturing a hearing aid may comprise providing a hearing aid housing. The method may also comprise positioning an audio-processing device within the hearing aid housing. The audio-processing device may be configured to receive a signal from the microphone and send the signal to a receiver. The method may further comprise coupling a battery door to the hearing aid housing to form a battery cavity. The battery door may be movable about an axis of rotation that extends through a circular cross section of the battery cavity to move the battery door between open and closed positions.

In at least one embodiment, the axis of rotation of the battery door is at least substantially parallel with the cylindrical axis of the batter cavity. A portion of the battery door may be positioned between positive and negative battery contacts. The battery door may be at least substantially concentric with the battery cavity. The battery door may also be configured to at least partially retract into the hearing aid housing. In some embodiments, the hearing aid housing encloses a first volume. The first volume may include the battery cavity. A ratio of the volume of the battery cavity to the first volume may be at least 0.10. In some embodiments, the battery door may be semicylindrically shaped.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
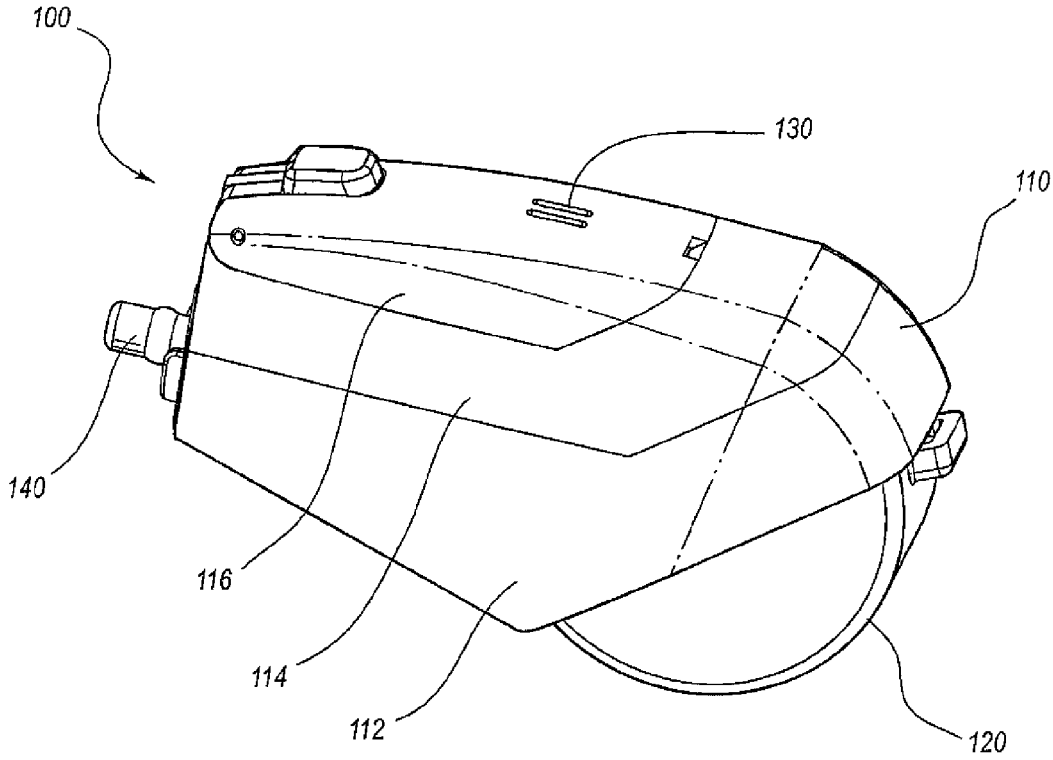
FIG. 1 is a perspective view of an exemplary hearing aid according to certain embodiments.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives failing within the scope of the appended claims.

DETAILED DESCRIPTION

The following is intended to provide a detailed description of various exemplary embodiments and should not be taken to be limiting in any way. Various exemplary hearing aid housing embodiments are disclosed herein. For example, the instant disclosure presents a hearing aid battery door with an axis of rotation that extends through a circular cross section of a battery cavity. Embodiments of the instant disclosure also provide hearing aids with battery-cavity-to-housing ratios of greater than 0.10, as discussed in greater detail below. Embodiments of the instant disclosure may have various other features and may apply to various types of hearing aids. As disclosed in greater detail below, the systems, methods, and apparatuses discussed herein may provide advantages and features over prior hearing aids.

FIG. 1 illustrates a hearing aid 100. Hearing aid 100 may be a behind-the-ear hearing aid. Embodiments of the instant disclosure may be implemented in various other types of hearing aids, such as completely-in-the-canal hearing aids, mini-canal hearing aids, in-the-canal hearing aids, half-shell hearing aids, in-the-ear hearing aids, open-car hearing aids, receiver-in-the-ear hearing aids, or any other suitable types of hearing aids. In other words, embodiments of the instant disclosure may apply to hearing aids of various different shapes and sizes.

Hearing aid 100 may comprise a housing 110. Housing 110 may comprise a battery door 120 and a vent 130 to allow sound to pass to an input device (e.g., a microphone). Housing 110 may also include an output nozzle 140 for carrying sound from a receiver to a user's ear. As shown in FIG. 1, battery door 120 may extend at least partially outside a body of housing 110. The body of housing 110 may comprise a canopy 116, an upper shell 114, and a lower shell 112. Since battery door 120 extends partially outside the body of housing 110, battery door 120 may hold a portion of a battery outside the body of housing 110.

Figure 2:
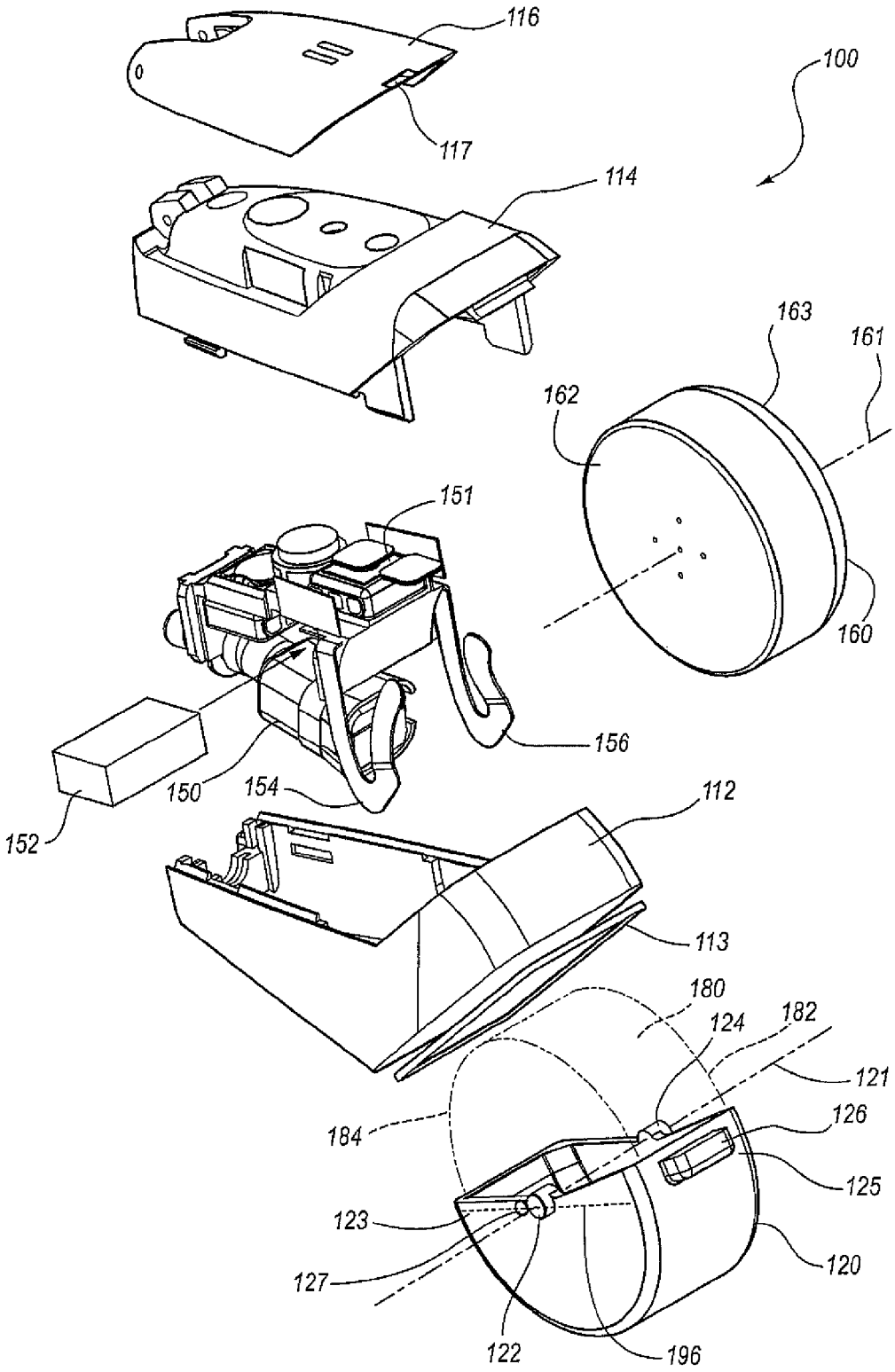
FIG. 2 is an exploded view of the exemplary hearing aid illustrated in FIG. 1.

FIG. 2 shows an exploded view of hearing aid 100. As shown in FIG. 2, canopy 116 may attach to upper shell 114. Upper shell 114 may attach to lower shell 112 to form the body of hearing aid 100. In other embodiments, a body of hearing aid 100 may be a single structure, two structures, or more than three structures. Battery door 120 may be dimensioned to fit within a back section of lower shell 112. A seal 113 may fit around the interface between battery door 120 and lower shell 112 to prevent moisture and other debris from entering into hearing aid 100.

FIG. 2 also shows various internal components of hearing aid 100. For example, hearing aid 100 may include a negative battery contact 154 and a positive battery contact 156. Battery contacts 154 and 156 may be coupled to an audio processing device 152. Audio processing device 152 may receive audio signals from a microphone 151 (or from multiple microphones) and send the signals to a receiver 150. Audio processing device 152 may perform various audio processing functions, such as amplifying a signal, modifying a signal to compensate for hearing loss, reducing noise in a signal, and/or reducing the effect of acoustic feedback in the signal. Audio-processing device 152 may also perform other audio processing functions. Audio-processing device 152 may be positioned within and enclosed by housing 110.

A battery 160 may power hearing aid 100. Battery contact 154 may be positioned to contact a negative terminal 162 of battery 160, and battery contact 156 may be positioned to contact a positive terminal 163 of battery 160. Battery 160 may need air to operate. For example, battery 160 may be a zinc-air battery. Thus, canopy 116 may include a vent 117 to allow air to circulate to battery 160.

Battery door 120 may be coupled to lower shell 112 of hearing aid housing 110. Battery door 120 may have axles 122 and 124 that attach battery door 120 to lower shell 112 and allow battery door 120 to rotate about an axis of rotation 121. Any other suitable mechanism may also be used to connect battery door 120 to lower shell 112. Battery door 120 may be coupled to lower shell 112 to provide a battery cavity 180. Battery 160 may be positioned within battery cavity 180.

Axis of rotation 121 may extend through a circular cross section of battery cavity 180. In other words, battery door 120 may rotate about an axis (i.e., axis of rotation 121) that extends through a circular cross section (or cylindrical cross section) of battery cavity 180. A circular cross section of battery cavity 180 may be any longitudinal cross section through battery cavity 180 that is taken between a top 182 and a bottom 184 of battery cavity 180. Thus, an axis that extends through a circular cross section of battery cavity 180 may be an axis that also extends through top 182 and/or bottom 184 of battery cavity 180.

Figure 8:
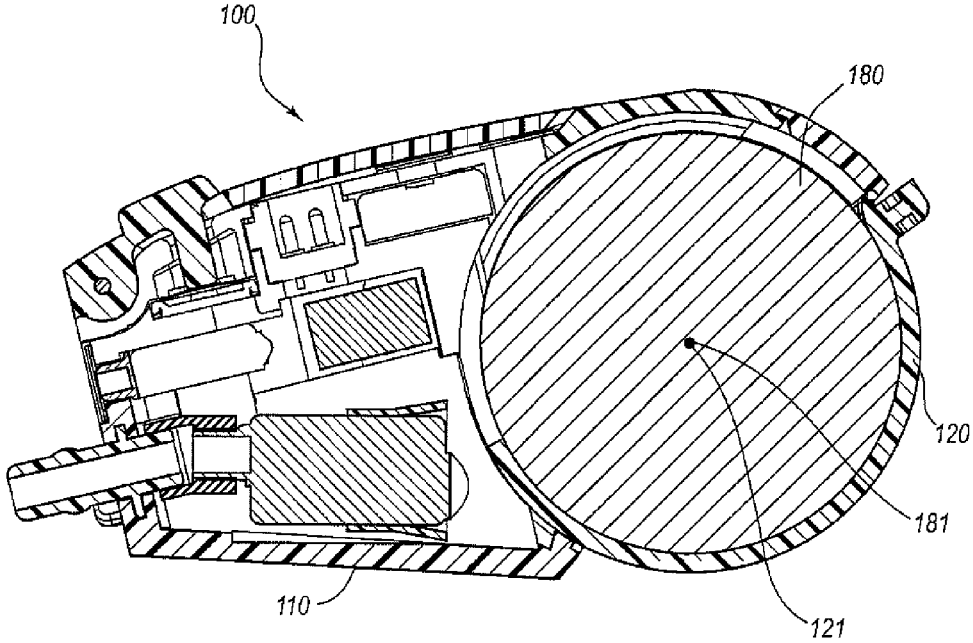
FIG. 8 is a cross-sectional view of the hearing aid illustrated in FIG. 1.

In some embodiments, axis of rotation 121 of battery door 120 may be at least substantially parallel (i.e., almost or exactly parallel) with a cylindrical axis of battery cavity 180 (FIG. 8 shows a cylindrical axis 181 of battery cavity 180). A cylindrical axis of battery cavity 180 may be coaxial with a cylindrical axis 161 of battery 160 when battery 160 is positioned within battery cavity 180. Thus, axis of rotation 121 may be at least substantially parallel with cylindrical axis 161 of battery 160 when battery 160 is positioned within battery cavity 180. In some embodiments, axis of rotation 121 may also be coaxial with cylindrical axis 161 of battery 160 when battery 160 is positioned within battery cavity 180.

Battery door 120 may have a diameter 196. A center of battery door 120 may be a midpoint of diameter 196. Thus, axis of rotation 121 may pass through a center of battery door 120. Battery door 120 may be concentric with battery cavity 180. Thus, in addition to passing through a center of battery door 120, axis of rotation 121 may pass through a center of battery cavity 180. In such embodiments, battery door 120 may rotate around battery cavity 180 when battery door 120 opens and closes.

Figure 4:
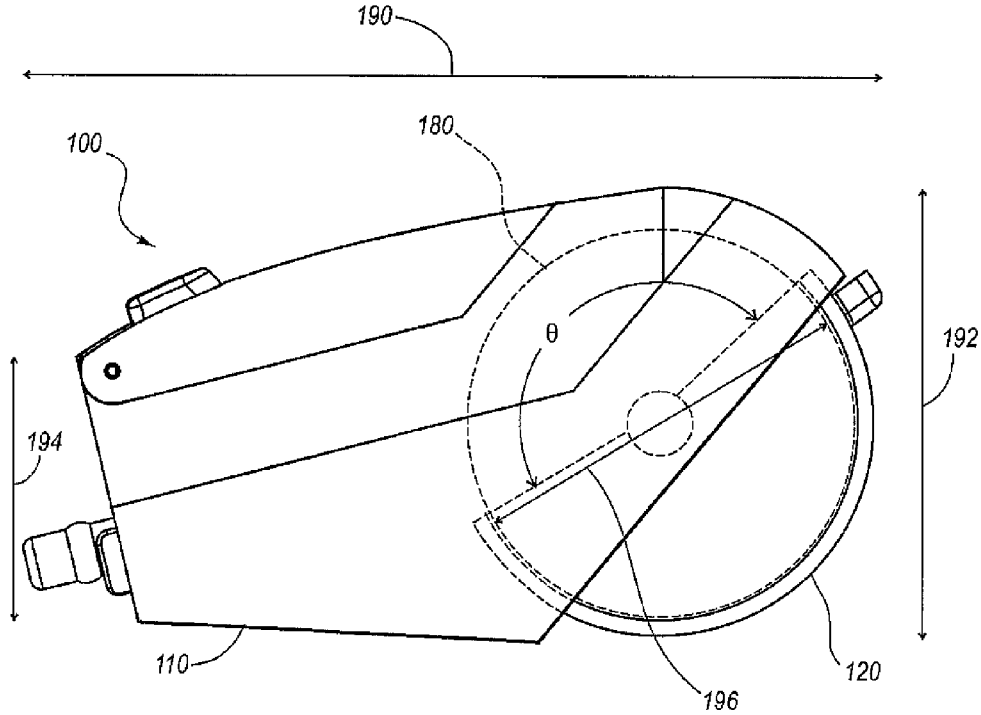
FIG. 4 is a side view of the exemplary hearing aid illustrated in FIG. 1.
Figure 5:
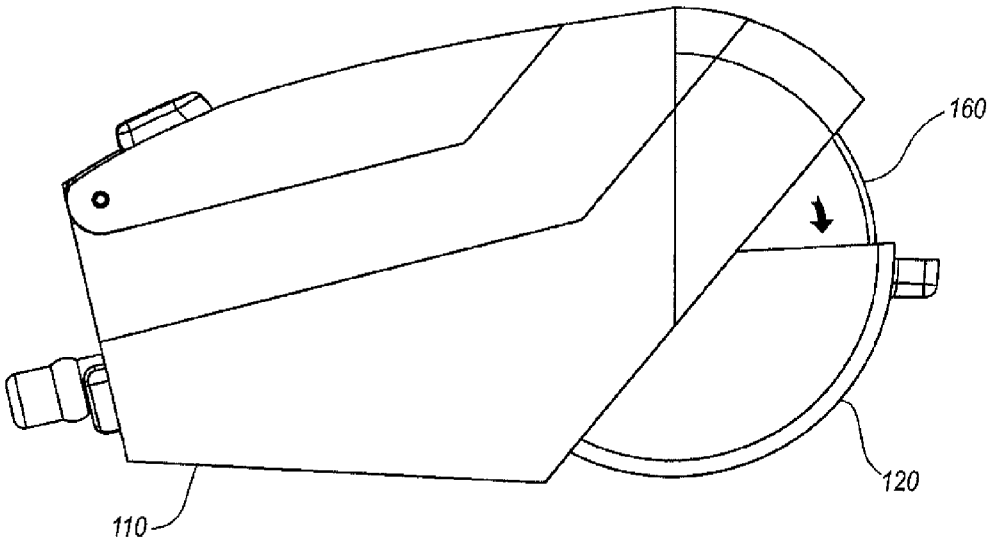
FIG. 5 is another side view of the exemplary hearing aid illustrated in FIG. 4 with the battery door partially open.
Figure 6:
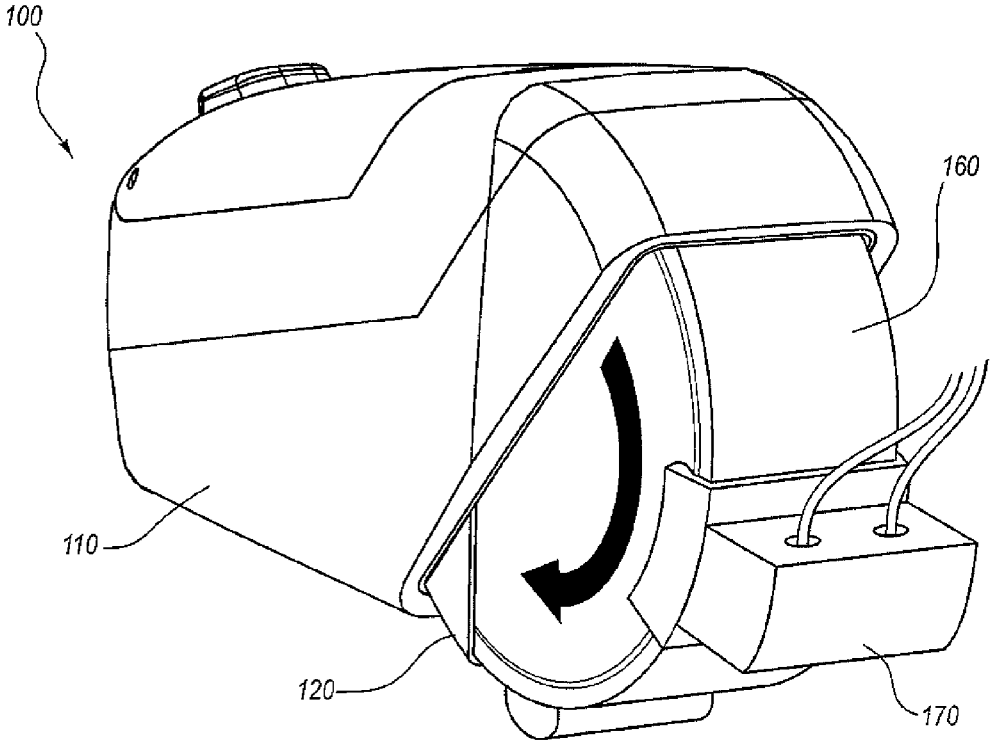
FIG. 6 is a perspective view of the exemplary hearing aid illustrated in FIG. 4 with the battery door completely open.

Battery door 120 may comprise a protrusion 127. Protrusion 127 may hold the battery door in an open position, a partially-open position, or a closed position, as shown in FIGS. 4-6. Protrusion 127 may bear against housing 110, and housing 110 may have detents that engage protrusion 127 in the open, partially-open, and/or closed positions. Hearing aid 100 may also include any other suitable mechanism for holding battery door 120 in open, partially open, and/or closed positions. Battery door 120 may comprise a first end 123 and a second end 125. First end 123 may be positioned within hearing aid housing 110. Second end 125 may comprise a tab 126 extending away from hearing aid housing 110. Tab 126 may help a user open and close battery door 120

Figure 3:
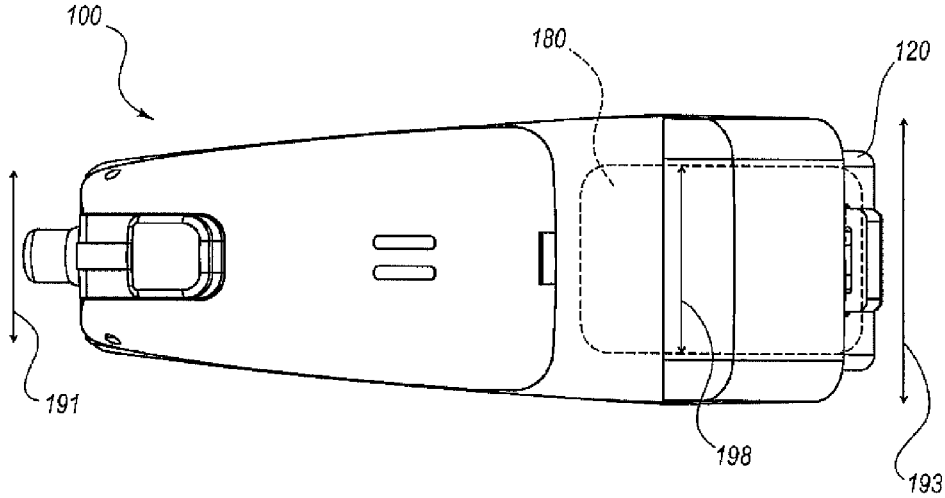
FIG. 3 is a top view of the exemplary hearing aid illustrated in FIG. 1.

FIG. 3 is a top view of hearing aid 100 and FIG. 4 is side view of hearing aid 100. FIGS. 3 and 4 show various dimensions of hearing aid 100. Hearing aid 100 may have a larger housing-body to battery-cavity ratio than prior hearing aids. Thus, the configuration of hearing aid 100 may allow a relatively small hearing aid to use a relatively large battery. For example a length 190 of hearing aid 100 may be approximately 0.9 inches or less, and a height 192 of hearing aid 100 may be approximately 0.6 inches or less. A width 191 of a front end of hearing aid 100 may be approximately 0.3 inches or less, and a width 193 of a back end of hearing aid 100 may be approximately 0.35 inches or less. A width of battery door 120 may be approximately 0.2 inches. In contrast to these relatively small hearing aid dimensions, battery cavity 180 may have relatively large dimensions. For example, a diameter 196 of battery cavity 180 may be 0.4 inches or more, and a width 198 of battery cavity 180 may be 0.2 inches or more.

FIGS. 3 and 4 also illustrate exemplary ratios of the dimensions of housing 110 relative to the dimensions of battery cavity 180. A ratio of width 193 of housing 110 to width 198 of battery cavity 180 may be approximately 1.75 or more. A ratio of width 191 of housing 110 to width 198 of battery cavity 180 may be approximately 1.5 or more. A ratio of height 192 of housing 110 to diameter 196 of battery cavity 180 may be approximately 1.5 or more. A ratio of length 190 of housing 110 to diameter 196 of battery cavity 180 may be approximately 2.25 or more.

FIGS. 3 and 4 illustrate an example of hearing aid housing and battery cavity dimensions. Various other hearing aid housing and battery dimensions fall within the scope of the instant disclosure. For example, in some embodiments, a hearing aid housing may be larger or smaller than housing 110, and a battery cavity may be larger or smaller than battery cavity 180. Also, housing to battery cavity dimension ratios may be larger or smaller than illustrated in FIGS. 3 and 4.

FIG. 4 shows that battery door 120 may be semicylindrically shaped. In other words, battery door 120 may be shaped like a portion of a cylinder. As shown in FIG. 2, battery door 120 may be shaped like slightly more than half a cylinder (e.g., an angle θ of an opening of battery door 120 may be less than 180 degrees). In other embodiments, battery door 120 may be dimensioned such that Θ is equal to or greater than 180 degrees.

FIG. 5 shows that battery door 120 may rotate to open and expose battery 160. In other words, battery door 120 may retract to expose a portion of battery 160. Battery door 120 may rotate around battery 160, and battery door 120 may be concentric or substantially concentric with battery 160. In some embodiments, battery door 120 may have a diameter that is slightly larger than the diameter of battery 160.

Battery door 120 may retract to expose at least a portion of a negative terminal 162 and at least a portion of a positive terminal 163 of battery 160. In contrast, typical hearing aid doors only expose one terminal of a hearing aid battery. By exposing both terminals of a battery 160, battery door 120 may allow a battery charger to be connected to battery 160 while the battery 160 remains in hearing aid 100, as shown in FIG. 6.

FIG. 6 shows hearing aid 100 with battery door 120 in an open position. As previously mentioned, battery door 120 may retract to expose terminals 162 and 163 of battery 160, and terminals 162 and 163 may be coupled to a battery charger 170. FIG. 6 also shows that hearing aid 100 may hold battery 160 in a stationary position while battery door 120 is completely open. In other words, battery 160 may stay in place while battery door 120 opens and closes.

Figure 7:
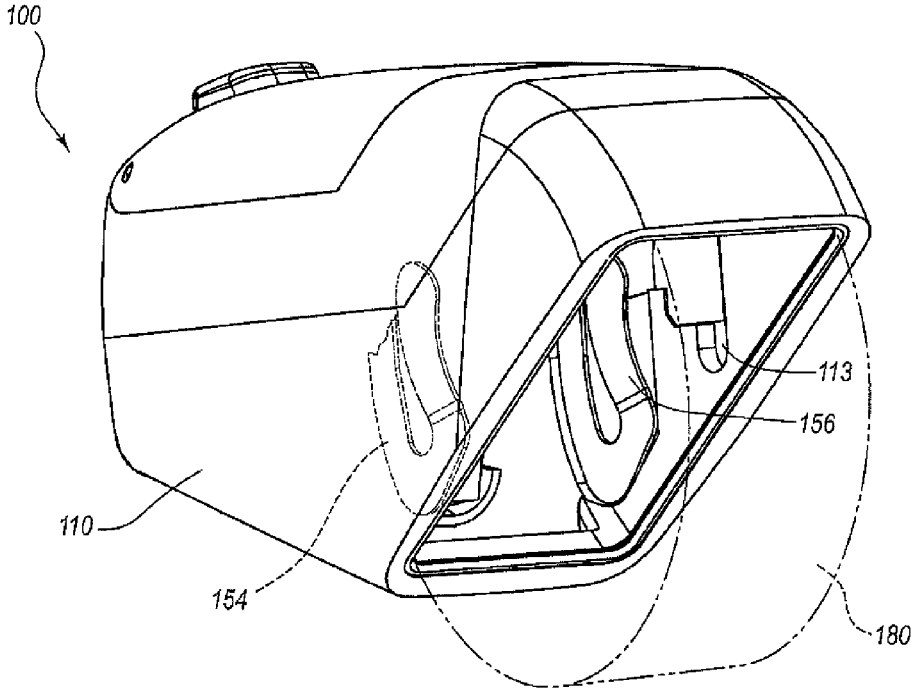
FIG. 7 is a perspective view of the hearing aid illustrated in FIG. 1.

FIG. 7 shows hearing aid 100 without battery door 120. As shown, positive battery contact 156 and negative battery contact 154 may be positioned in battery cavity 180. Positive battery contact 156 may be positioned to couple a positive terminal of battery 160 to audio-processing device 152, and negative battery contact 154 may be positioned to couple a negative terminal 162 of battery 160 to audio-processing device 152. When battery door 120 is coupled to housing 110, axle 124 may rest within recess 113 to allow battery door 120 to rotate. Battery door 120 may rotate to an open position that disconnects battery 160 from battery contacts 154 and 156. In other words, as battery door 120 opens, it may slide between terminal 162 and battery contact 154. Battery door 120 may also slide between battery terminal 163 and battery contact 156. By disconnecting either or both of battery contacts 154 and 156 from their respective battery terminals, battery door 120 may turn hearing aid 100 off when battery door 120 is in an open position.

FIG. 8 shows a cross section of hearing aid 100. As shown, battery door 120 may partially enclose battery cavity 180. Battery cavity 180 may have a cylindrical axis 181. Axis of rotation 121 of battery door 120 may be coaxial with cylindrical axis 181 of battery cavity 180. In some embodiments, axis of rotation 121 may not be coaxial with cylindrical axis 181 but may be at least substantially parallel with cylindrical axis 181.

Figure 9:
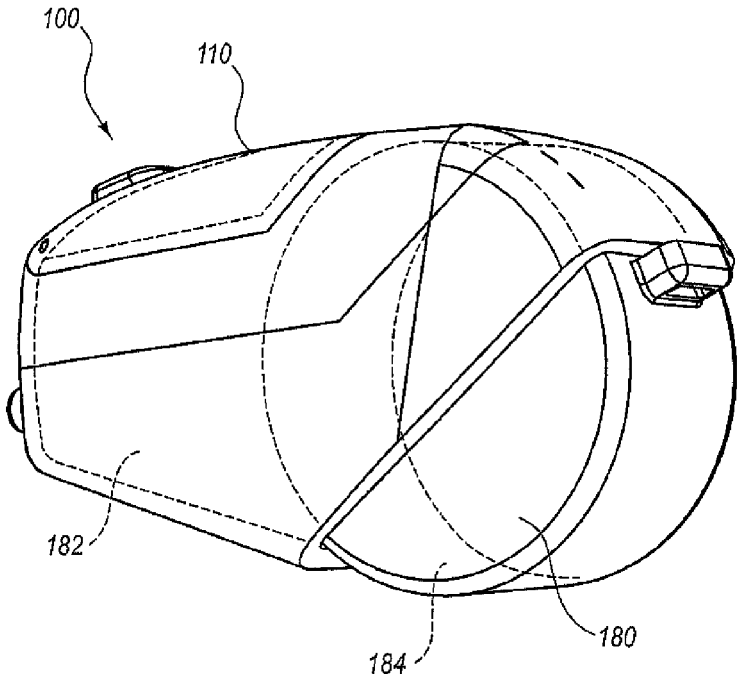
FIG. 9 is another perspective view of the hearing aid illustrated in FIG. 1.

FIG. 9 illustrates that hearing aid housing 110 may enclose a first volume 182. Volume 182 may include a volume enclosed by the body of hearing aid 100 and the additional volume 184 within battery cavity 180. In other words, volume 182 of hearing aid housing 110 may include a volume 184 of battery cavity 180 (i.e., volume 182 may represent the entire volume enclosed by housing 110). A ratio of volume 184 of battery cavity 180 to volume 182 of housing 110 may be at least 0.10. According to various embodiments, the ratio of volume 184 of battery cavity 180 to volume 182 of housing 110 may be at least 0.20 or at least 0.30. Thus, hearing aid 100 may be smaller than traditional hearing aids that use batteries that are the same size as the batteries used in hearing aid 100. Hearing aid 100 may provide a relatively small hearing aid that has battery life comparable to larger hearing aids. Accordingly, hearing aid 100 may provide the advantages of a small hearing aid (e.g., comfort and style) without sacrificing battery life.

Figure 10:
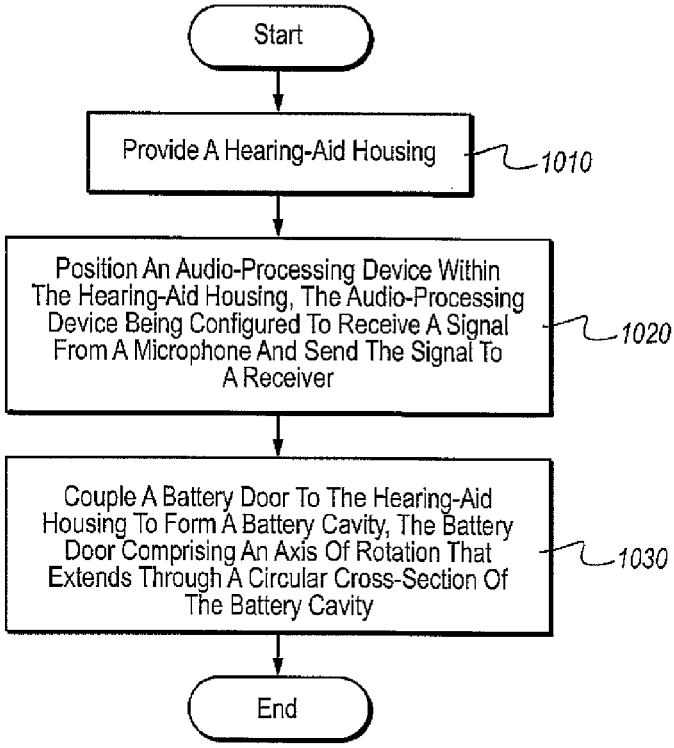
FIG. 10 is a flow diagram of a method for manufacturing a hearing aid according to certain embodiments.

FIG. 10 shows a flow diagram of a method of manufacturing a hearing aid. A hearing aid housing may be provided (step 1010). Then, an audio-processing device may be positioned within the hearing aid housing (step 1020). The audio-processing device may be configured to receive a signal from a microphone and send the signal to a receiver. A battery door may be coupled to the hearing aid housing to form a battery cavity (step 1030). The battery door may comprise an axis of rotation that extends through a circular cross section of the battery cavity. The hearing aid may also be manufactured with various other features illustrated in FIGS. 1-9.

The hearing aids disclosed herein may provide various advantages over prior hearing aids. For example, embodiments of the instant disclosure may provide relatively small hearing aids with longer battery life than prior hearing aids of comparable size. Embodiments of the instant disclosure may also provide hearing aids with battery doors that allow users to more easily replace and recharge batteries than prior battery doors. The hearing aids presented herein may also have various other advantages over prior hearing aids.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

We claim:

1. A hearing aid, comprising:

an audio-processing device configured to receive a signal from a microphone and send a processed signal to a receiver;

a hearing aid housing coupled to the audio-processing device, the hearing aid housing comprising:

a body including an air vent providing air to a battery of the hearing aid;

a battery door configured to open by at least partially retracting into the hearing aid housing, the battery door having a semicylindrical shape; and a seal positioned in an interface between the body and the battery door.

2. The hearing aid of claim 1, wherein:

the battery door is coupled to the body of the hearing aid housing to form a battery cavity;

an axis of rotation of the battery door is at least substantially parallel with a cylindrical axis of the battery cavity.

3. The hearing aid of claim 2, wherein:

the battery door is configured to retract to expose at least a portion of a negative terminal face and at least a portion of a positive terminal face, opposite to the negative terminal face, of a battery positioned in the battery cavity.

4. The hearing aid of claim 1, further comprising:

a positive battery contact, the positive battery contact being positioned to couple a positive terminal of a battery to the audio processing device;

a negative battery contact, the negative battery contact being positioned to couple a negative terminal of the battery to the audio processing device, wherein the battery door is configured to rotate to an open position that disconnects the battery from the positive and negative battery contacts.

5. The hearing aid of claim 1, wherein:

the hearing aid housing encloses a first volume;

a battery cavity encloses a second volume;

the first volume comprises the second volume;

a ratio of the second volume to the first volume is at least 0.10.

* * * * *